US006003502A

United States Patent [19]

Akagi et al.

[11] Patent Number: 6,003,502

[45] Date of Patent: Dec. 21, 1999

[54] MECHANISM FOR COORDINATING OPERATION OF THROTTLE VALVES IN CARBURETOR SYSTEM

[75] Inventors: Takashi Akagi; Suminari Iwao, both of Wako, Japan

[73] Assignee: Honda Giken Kogyo Kabushiki Kaisha, Tokyo, Japan

[21] Appl. No.: 09/145,330

[22] Filed: Sep. 1, 1998

[30] Foreign Application Priority Data

Sep. 24, 1997 [JP] Japan ..... 9-259122

[51] Int. Cl.[6] ..... F02B 13/00; F02D 9/00

[52] U.S. Cl. ..... 123/579; 123/583

[58] Field of Search ..... 123/579, 583, 123/580, 581, 582; 251/305

[56] References Cited

U.S. PATENT DOCUMENTS

| | | | |
|---|---|---|---|
| 2,074,353 | 3/1937 | Aseltine | 137/595 |
| 2,299,919 | 10/1942 | Moore et al. | 123/442 |
| 2,640,472 | 6/1953 | Bicknell | 123/584 |
| 2,801,834 | 8/1957 | Roualet et al. | 261/23.2 |
| 2,807,448 | 9/1957 | Morton | 261/23.1 |
| 3,362,694 | 1/1968 | Gould | 261/23.2 |
| 5,367,998 | 11/1994 | Shiohara et al. | 123/457 |

FOREIGN PATENT DOCUMENTS

| | | | |
|---|---|---|---|
| 2033624 | 12/1982 | Germany | 123/579 |
| 28449 | 6/1909 | United Kingdom | 123/583 |

*Primary Examiner*—Noah P. Kamen
*Assistant Examiner*—Hai Huynh
*Attorney, Agent, or Firm*—Birch, Stewart, Kolasch & Birch, LLP

[57] ABSTRACT

To provide a mechanism for coordinating the operation of throttle valves in a carburetor system in which a plurality of carburetors are connected in series and are then arranged in parallel with one another so as to position shafts thereof in parallel with one another. The throttle valves are rotated on said shafts to open or close passages of the carburetors. In the throttle valve operation coordinating mechanism, each of the carburetors connected in series shares one shaft which is received in bearings positioned at opposite ends thereof. A link extends between the shafts of the carburetors arranged in parallel and coordinates the operation of the shafts.

19 Claims, 3 Drawing Sheets

MECHANISM FOR COORDINATING OPERATION OF THROTTLE VALVES IN CARBURETOR SYSTEM

BACKGROUND OF THE INVENTION

1. Field of the Invention

The present invention relates to a mechanism for coordinating the operation of carburetor throttle valves in a multi-cylinder internal combustion engine, for example.

2. Description of the Related Art

Conventional carburetors used in multi-cylinder internal combustion engines employ a mechanism similar to that shown in FIG. 3 to coordinate operation of the throttle valves. FIG. 3 is a plan view of the carburetor arrangement used in a V-type 4 cylinder internal combustion engine. Numeral 1 indicates the top edge of the internal combustion engine. Numeral 3 indicates the carburetors provided on top of each of the cylinders.

Numeral 4 indicates throttle valves. These throttle valves 4, are supported on shafts 5, arranged across the individual carburetors 3. The throttle valves 4 open and close with the rotation of the shafts 5. Also, adjacent pairs of carburetors 3 are arranged in series such that the shafts 5 are coaxial. Furthermore, these carburetors 3 are juxtaposed such that their shafts 5 are parallel to each other.

In the case of the above conventional carburetors 3, each shaft 5 is rotatably supported in bearings 6 provided on opposite ends thereof. Furthermore, the tips of adjacent shafts 5 protrude from the bearings 6, and are connected to each other by operation coordinating mechanisms 7*a* and 7*b* provided at the tips the of shafts 5. Also, to one of these shafts 5 (the lower right shaft in FIG. 3) is attached a drive mechanism 8. The rotation of this shaft (driving shaft) 5 is transmitted, via the link 9 extending between the tips of the shafts 5 protruding from the bearings 6, to the shafts 5 (driven shafts) of the carburetors 3 arranged in parallel to the carburetors on the driving side.

That is, in the conventional carburetor 3, when the shaft 5 in the lower right of the figure is rotated by the drive mechanism 8, the rotation is transmitted to the shaft 5 (the upper right shaft in the figure) by the operation coordinating mechanism 7*a*, and then to one of the driven shafts (the upper left shaft) 5 via the link 9, then by the operation coordinating mechanism 7*b*, to the shaft 5 (the lower left shaft). As a result, the shafts 5 rotate together by an equal amount, and open or close the throttle valves 4, thereby controlling the volume of air delivered to each of the cylinders.

However, in the above conventional throttle valve operation coordinating device, the link 9 extends between the tips of the shafts 5. Therefore, the link 9 is supported in a cantilever fashion by one end of the shaft 5. Particularly on the driven shafts 5, when rotation is transmitted through the link 9, the shaft 5 is pushed by the link 9 as shown by the arrow M in the figure, causing a swing left or right with the bearings 6 acting as a fulcrum. It is possible that the motion of the link 9 not be converted into the rotation of the shafts 5 correctly. Therefore, in the above conventional throttle valve operation coordinating device, to prevent the swing of the shafts 5 in the driven side carburetor 3 and the non-uniformity of the opening and closing amount and opening and closing time of the throttle valves 4 attached to them, despite the high cost, it is necessary to use bearings 6 to hold the shafts 5 firmly.

SUMMARY OF THE INVENTION

An object of the present invention, taking into account the above situation of the related art, is to provide an inexpensive mechanism for allowing smooth and reliable operation of the throttle valves 4 of the driven side carburetors 3.

The object of the present invention is to provide a mechanism for coordinating the operation of throttle valves in a carburetor system in which a plurality of carburetors are connected in series and are then arranged in parallel with one another so as to position shafts thereof in parallel with one another. The throttle valves are turned on the shafts to open or close passages. Each of the carburetors connected in series shares one shaft which is received in bearings positioned at opposite ends thereof, and a link extends between the shafts of the carburetors arranged in parallel and coordinates the operation of the shafts of the carburetors.

With this throttle valve operation coordinating mechanism, both ends of the shafts supporting the link are received in their respective bearing, so that the link is supported at its opposite ends and the stability of the shafts can be increased. It follows that, when rotation is transmitted by the link, the driven shafts do not sway left or right even though they are pushed by the link.

Further, carburetors arranged in series may be formed as one integral part in order to improve the rigidity and support precision of the shafts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
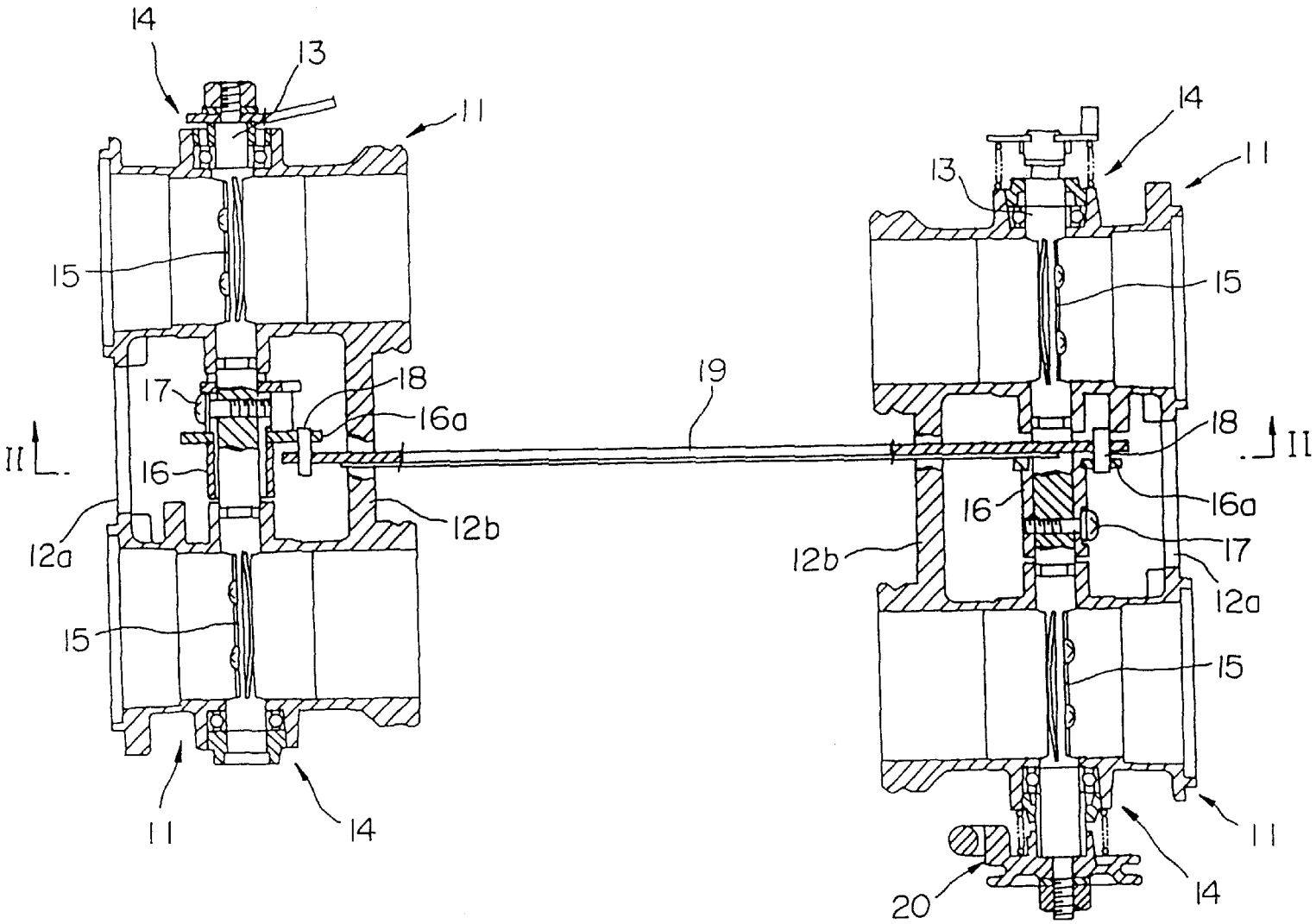
FIG. 1 is a sectional view showing the carburetor throttle valve operation coordinating mechanism according to the invention.
Figure 2:
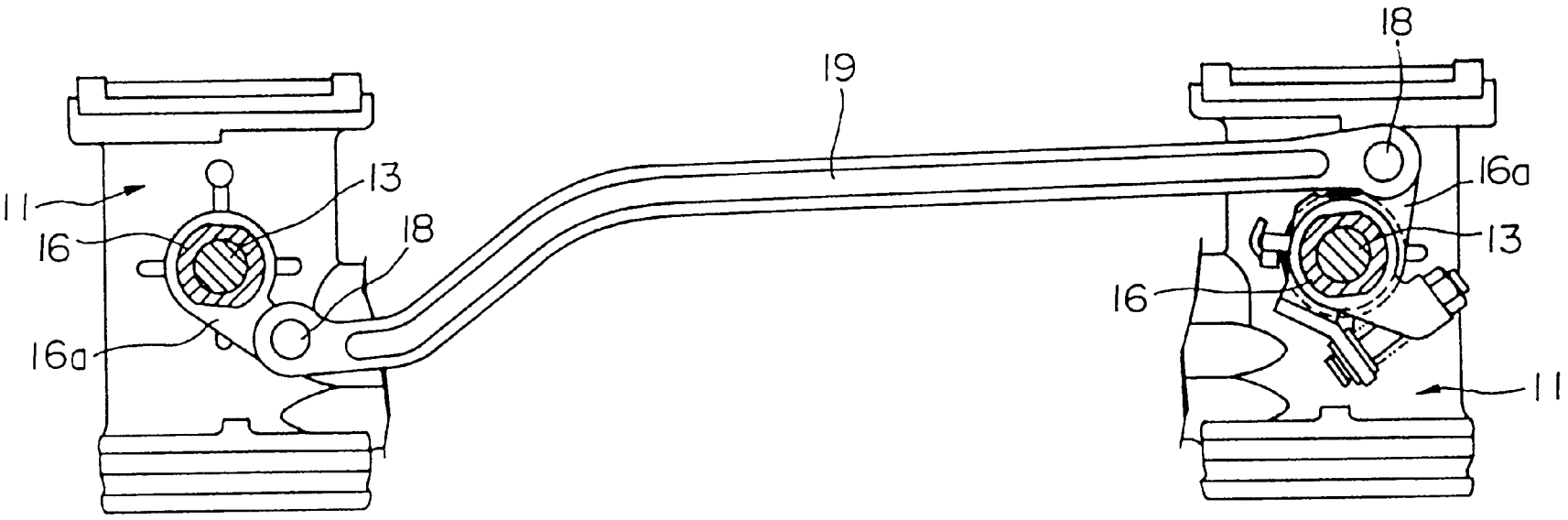
FIG. 2 is a partial sectional view of the carburetor throttle valve operation coordinating mechanism, taken along line II—II in FIG. 1.
Figure 3:
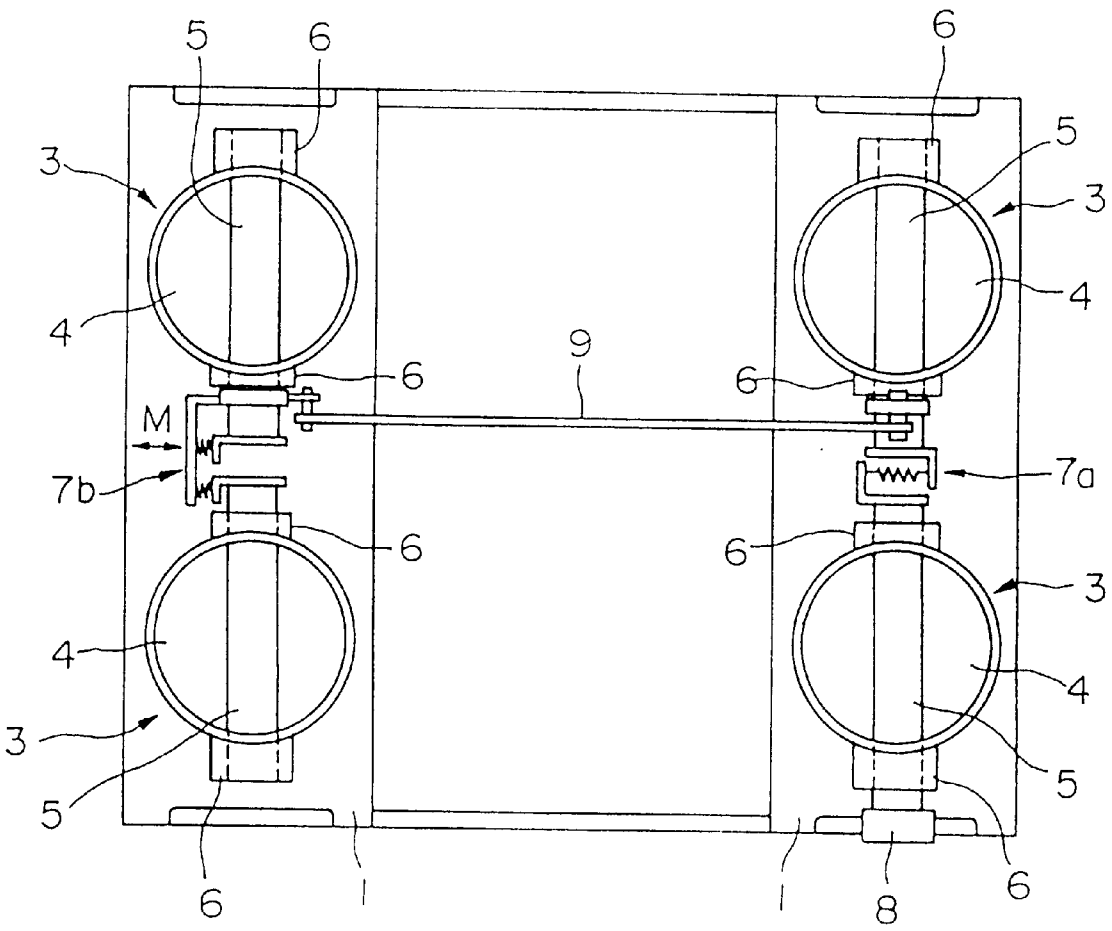
Fig. 3 BACKGROUND ART
FIG. 3 illustrates an example of a conventional carburetor throttle valve interlocking mechanism.

The present invention concerning the throttle valve operation coordinating mechanism will be described below based on the attached drawings. The throttle valve operation coordinating mechanism shown in FIG. 1 and FIG. 2 is applied to carburetors used in a V-type 4 cylinder internal combustion engine. FIG. 1 is a cross section of the carburetors, depicted with the axes thereof extending in parallel with the plane of FIG. 1.

Numeral 11 indicates the carburetors provided at the top of each of their respective cylinders (not shown). These carburetors 11 are cylindrical and the adjacent pair of carburetors 11 are arranged in series similar to the above mentioned conventional carburetors 3. Also, adjacent carburetors 11 are coupled together via pairs of stays 12*a* and 12*b*.

Each of the shafts 13 extends through the carburetors connected in series, and is rotatably supported at its end in a bearing 14 provided at one end of one of the carburetors connected in series. A pair of carburetors 11 are connected in series with the shaft partially exposed therebetween.

Throttle valves 15 are supported by the shafts 13 inside the carburetors 11. Similarly to the above conventional throttle valves 4, the throttle valves open or close in response to the rotation of the shafts 13. Also, the above pairs of carburetors 11, similarly to the above conventional carburetors 3, are juxtaposed such that the shafts 13 are parallel to each other.

Collars 16 are mounted on the exposed parts of the shafts 13 between the adjacent carburetors 11. The collars 16 are fixed onto the shafts 13 by screws 17 etc. Connecting tabs 16*a* extend radially from the collars 16. Pins 18 parallel to the shafts 13 are fixed to the connecting tabs 16*a*. Further, a link 19 extends between the pins 18 of the juxtaposed carburetors 11. A drive mechanism 20 is connected to one of the shafts 13 (i.e. the driving shaft at the right side in the figure) of the carburetor in order to rotate the shaft 13.

In the foregoing carburetor 11, if the shafts 13 on the right side of the figure are rotated by the drive mechanism 20, the throttle valves 15 on the right side of the figure turn on the shaft 13 to open and close a passage. The rotation of the shaft 13 is transmitted via the connecting tabs 16*a*, pins 18, and link 19 to the driven shaft 13 in the carburetor 11 on the left side in the figure. As a result, this throttle valve operation coordinating mechanism also rotates the shaft 13 on each of the carburetors 11 and the throttle valves 15 open or close the passages by equal amounts, thereby controlling the volume of air delivered to each of the cylinders.

In the throttle valve operation coordinating mechanism of the present invention, ends of the shafts 13 are supported in the respective bearings 14 formed in the carburetors 11. Furthermore, the link 19 extends between the longitudinal centers of the shafts 13 and the link 19 becomes supported at its opposite ends, so that the stability of the shafts 13 is improved. It follows that, when rotation is transmitted by the link 19, the driven shaft 13 will not swing left or right even though it is pushed by the link 19. As a result, even without providing new bearings etc., the motion of the link 19 is correctly converted into rotational force for the driven shaft 13. The throttle valves in the driven carburetors 11 can be realized at a low cost, and assure smooth and precise operation.

Furthermore, the carburetors 11 include the stays 12*a* and 12*b* as integral parts, so that the rigidity of the carburetors 11 and the positional precision of the bearings 14 can be increased, and the operation of the throttle valves 15 also becomes more accurate.

According to the present invention, in the throttle valve operation coordinating mechanism, both tips of the shaft supporting the link are supported in their respective bearings. The link is supported at its ends by the shafts, so the stability of the shaft is improved. It follows that, when rotation is transmitted by the link, the driven shaft will not swing left or right even though it is pushed by the link. As a result, even without providing new bearing etc., the link reliably converts its motion to the rotational force for the driven shaft. The throttle valves in the driven carburetors can be produced at a reduced cost, and can assure smooth and precise operation.

Also, when carburetors to be connected in series are formed as an integral part, the rigidity of the carburetors and the support precision of the shafts can be improved, and the operation of the throttle valves becomes more accurate.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A mechanism for coordinating the operation of throttle valves in a carburetor system comprising:

a first plurality of carburetors connected in series by a first shaft each of said first plurality of carburetors including at least one barrel;

a second plurality of carburetors connected in series by a second shaft, each of said second plurality of carburetors including at least one barrel, said first and second plurality of shafts being arranged in parallel with each other;

throttle valves mounted for rotation on said shafts within each of said at least one barrel of each of said carburetors, said throttle valves opening and closing passages of said carburetors;

a pair of bearings positioned at opposite ends of each of said shafts for mounting said shafts for rotation; and a link extending between and connected to a longitudinal center of said shafts for coordinating the operation of said throttle valves of said carburetors, said link.

2. The mechanism for coordinating the operation of throttle valves in a carburetor system according to claim 1, wherein said carburetors connected in series are formed as an integral one piece member.

3. The mechanism for coordinating the operation of throttle valves in a carburetor system according to claim 1, wherein a collar is mounted on said longitudinal center of each of said first and second shafts, and said link is connected between said first and second shafts through said collars.

4. The mechanism for coordinating the operation of throttle valves in a carburetor system according to claim 3, wherein said link is connected to each of said collars through a projection formed on each of said collars and a pin.

5. The mechanism for coordinating the operation of throttle valves in a carburetor system according to claim 1, wherein said first shaft is a driving shaft and said second shaft is a driven shaft, said driving shaft being driven by a driving device.

6. The mechanism for coordinating the operation of throttle valves in a carburetor system according to claim 1, wherein the links are arranged at exposed parts of the shafts between adjacent carburetors.

7. A mechanism for coordinating the operation of throttle valves in a carburetor system comprising:

a driving shaft for connecting a plurality of first carburetors in series, each of said plurality of first carburetors including at least one barrel;

a driven shaft for connecting a plurality of second carburetors in series, each of said plurality of second carburetors including at least one barrel, said shafts arranged in parallel with each other;

a throttle valve mounted on said driving and driven shafts within each of said at least one barrel of each of said first and second plurality of carburetors; and a link operatively connected between and connected to a longitudinal center of said driving and driven shafts for transmitting rotation of said driving shaft to said driven shaft.

8. The mechanism for coordinating the operation of throttle valves in a carburetor system according to claim 7, wherein a collar is mounted on said longitudinal center of each of said driving and driven shafts, and said link is connected between said driving and driven shafts through said collars.

9. The mechanism for coordinating the operation of throttle valves in a carburetor system according to claim 8, wherein said link is connected to each of said collars through a projection formed on each of said collars and a pin.

10. The mechanism for coordinating the operation of throttle valves in a carburetor system according to claim 7, further comprising a driving device for driving said driving shaft.

11. The mechanism for coordinating the operation of throttle valves in a carburetor system according to claim 7, further comprising bearings for mounting said driving and driven shafts for rotation, said bearings located on ends of said driving and driven shafts.

12. A mechanism for coordinating the operation of throttle valves in a carburetor system comprising:

a first carburetor assembly, said first carburetor assembly including a plurality of first carburetors connected in series by a first shaft, each of said plurality of first carburetors including at least one barrel;

a second carburetor assembly, said second carburetor assembly including a plurality of said carburetors connected in series by a second shaft, each of said plurality of second carburetors including at least one barrel;

a throttle valve mounted for rotation on said shafts within each of said at least one barrel of each of said carburetors; and a link extending between and connected to a longitudinal center of said shafts for coordinating the operation of said throttle valves of said carburetors.

13. The mechanism for coordinating the operation of throttle valves in a carburetor system according to claim 12, wherein said plurality of carburetors in each of said first and second carburetor assemblies is formed as an integral one piece member.

14. The mechanism for coordinating the operation of throttle valves in a carburetor system according to claim 12, wherein said plurality of carburetors in said first carburetor assembly is arranged in parallel with said plurality of carburetors in said second carburetor assembly.

15. The mechanism for coordinating the operation of throttle valves in a carburetor system according to claim 12, wherein said first shaft is arranged in parallel with said second shaft.

16. The mechanism for coordinating the operation of throttle valves in a carburetor system according to claim 12, wherein a collar is mounted on said longitudinal center of each of said first and second shafts, and said link is connected between said first and second shafts through said collars.

17. The mechanism for coordinating the operation of throttle valves in a carburetor system according to claim 16, wherein said link is connected to each of said collars through a projection formed on each of said collars and a pin.

18. The mechanism for coordinating the operation of throttle valves in a carburetor system according to claim 12, wherein said first shaft is a driving shaft and said second shaft is a driven shaft, said driving shaft being driven by a driving device.

19. The mechanism for coordinating the operation of throttle valves in a carburetor system according to claim 12, further comprising bearings for mounting said first and second shafts for rotation, said bearings located on ends of said first and second shafts.

* * * * *